US010364829B2

(12) United States Patent
Lee

(10) Patent No.: US 10,364,829 B2
(45) Date of Patent: Jul. 30, 2019

(54) VACUUM PUMP

(71) Applicant: SAMSUNG ELECTRONICS CO., LTD., Suwon-si, Gyeonggi-do (KR)

(72) Inventor: Kwang Jae Lee, Hwaseong-si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 206 days.

(21) Appl. No.: 15/379,888

(22) Filed: Dec. 15, 2016

(65) Prior Publication Data

US 2017/0321723 A1 Nov. 9, 2017

(30) Foreign Application Priority Data

May 4, 2016 (KR) ..... 10-2016-0055145

(51) Int. Cl.

| | |
|---|---|
| ***F04D 29/62*** | (2006.01) |
| ***F04D 17/10*** | (2006.01) |
| ***F04D 29/053*** | (2006.01) |
| ***F04D 29/28*** | (2006.01) |
| ***F04D 29/42*** | (2006.01) |

(52) U.S. Cl.

CPC ..... *F04D 29/624* (2013.01); *F04D 17/10* (2013.01); *F04D 29/053* (2013.01); *F04D 29/28* (2013.01); *F04D 29/4206* (2013.01)

(58) Field of Classification Search

CPC ..... F04D 19/04; F04D 19/042; F04D 19/044; F04D 29/624; F04D 17/10; F04D 29/053; F04D 29/28; F04D 29/4206; F04D 17/14; F04D 29/05; F04D 29/054; F04D 29/289; F04D 29/403; F04D 29/4213; F04D 29/441

USPC ..... 415/90, 91, 108, 109

See application file for complete search history.

(56) References Cited

U.S. PATENT DOCUMENTS

| | | | | |
|---|---|---|---|---|
| 2,642,004 | A * | 6/1953 | Bergh | F04D 13/06 415/108 |
| 3,168,977 | A * | 2/1965 | Garnier | F04D 19/042 415/100 |
| 3,877,546 | A * | 4/1975 | Shrader | F16N 7/366 184/6.18 |
| 4,023,920 | A * | 5/1977 | Bachler | F04D 19/048 415/90 |
| 4,946,345 | A * | 8/1990 | Watanabe | F04D 19/048 188/379 |
| 5,263,818 | A * | 11/1993 | Ito | F02M 37/08 418/15 |
| 5,609,478 | A * | 3/1997 | Utter | F04C 18/023 418/55.5 |
| 6,220,831 | B1 * | 4/2001 | Shiokawa | F04D 17/168 417/295 |
| 6,514,035 | B2 * | 2/2003 | Iwane | F04D 19/044 415/143 |
| 7,390,164 | B2 * | 6/2008 | Maejima | F04D 19/04 415/104 |
| 8,087,907 | B2 | 1/2012 | Kawasaki et al. | |

(Continued)

*Primary Examiner* — Nathaniel E Wiehe
*Assistant Examiner* — Emily S Adelman
(74) *Attorney, Agent, or Firm* — Lee & Morse, P.C.

(57) ABSTRACT

A vacuum pump includes a housing with an inlet port, a rotor part in the housing, the rotor part including a recess part facing the inlet port, and a plurality of rotating blades, a rotating shaft overlapping the recess part, and a capping part overlapping the rotating shaft and covering the recess part.

19 Claims, 11 Drawing Sheets

(56) References Cited

U.S. PATENT DOCUMENTS

| | | | | |
|---|---|---|---|---|
| 8,257,033 | B2 | 9/2012 | Oishi | |
| 8,356,970 | B2 | 1/2013 | Sugawara et al. | |
| 8,727,708 | B2 | 5/2014 | Moriya et al. | |
| 8,790,071 | B2 | 7/2014 | Oishi | |
| 2007/0274822 | A1* | 11/2007 | Liu | F04D 17/122<br>415/90 |
| 2008/0283125 | A1* | 11/2008 | Mordehai | F04D 19/042<br>137/101 |
| 2014/0072417 | A1 | 3/2014 | Tsutsui | |
| 2015/0063993 | A1 | 3/2015 | Tsutsui | |
| 2015/0184665 | A1 | 7/2015 | Yamato et al. | |
| 2015/0240829 | A1 | 8/2015 | Ohtachi et al. | |

* cited by examiner

VACUUM PUMP

CROSS-REFERENCE TO RELATED APPLICATION

Korean Patent Application No. 10-2016-0055145, filed on May 4, 2016, in the Korean Intellectual Property Office, and entitled: "Vacuum Pump," is incorporated by reference herein in its entirety.

BACKGROUND

1. Field

Example embodiments relate to a vacuum pump, and more particularly, to a vacuum pump included in semiconductor fabrication equipment.

2. Description of the Related Art

During fabrication of a semiconductor device, e.g., a memory or an integrated circuit (IC), there may be a need to perform a deposition process on a high-purity semiconductor substrate or wafer within a chamber at a high vacuum state in order to avoid the influence of impurities, e.g., dust in the air, on the deposition process. To form a high vacuum state in the chamber, a vacuum pump, e.g., a turbo pump, may be used for exhausting gas from the chamber.

SUMMARY

According to an aspect of the example embodiments, there is provided a vacuum pump including a housing with an inlet port, a rotor part disposed in the housing and including a recess part which faces the inlet port, and a plurality of rotating blades, a rotating shaft overlapping the recess part, and a capping part overlapping the rotating shaft and covering the recess part.

According to another aspect of the example embodiments, there is provided a vacuum pump including a housing including an inlet port, and a rotor part disposed in the housing and including a recess part which faces the inlet port, and a plurality of rotating blades, wherein the rotor part further includes exhaust holes, which extend from the recess part to between the rotating blades.

According to yet another aspect of the example embodiments, there is provided a vacuum pump, including a housing including an inlet port, a rotor part in the housing, the rotor part including a recess part facing the inlet port, and a plurality of rotating blades, a rotating shaft extending through a bottom of the recess part toward the inlet port, and a capping part overlapping the rotating shaft and a top of the recess part.

BRIEF DESCRIPTION OF THE DRAWINGS

Features will become apparent to those of ordinary skill in the art by describing in detail exemplary embodiments with reference to the attached drawings, in which.

DETAILED DESCRIPTION

A vacuum pump according to some exemplary embodiments will hereinafter be described with reference to FIGS. 1 and 2.

Figure 1:
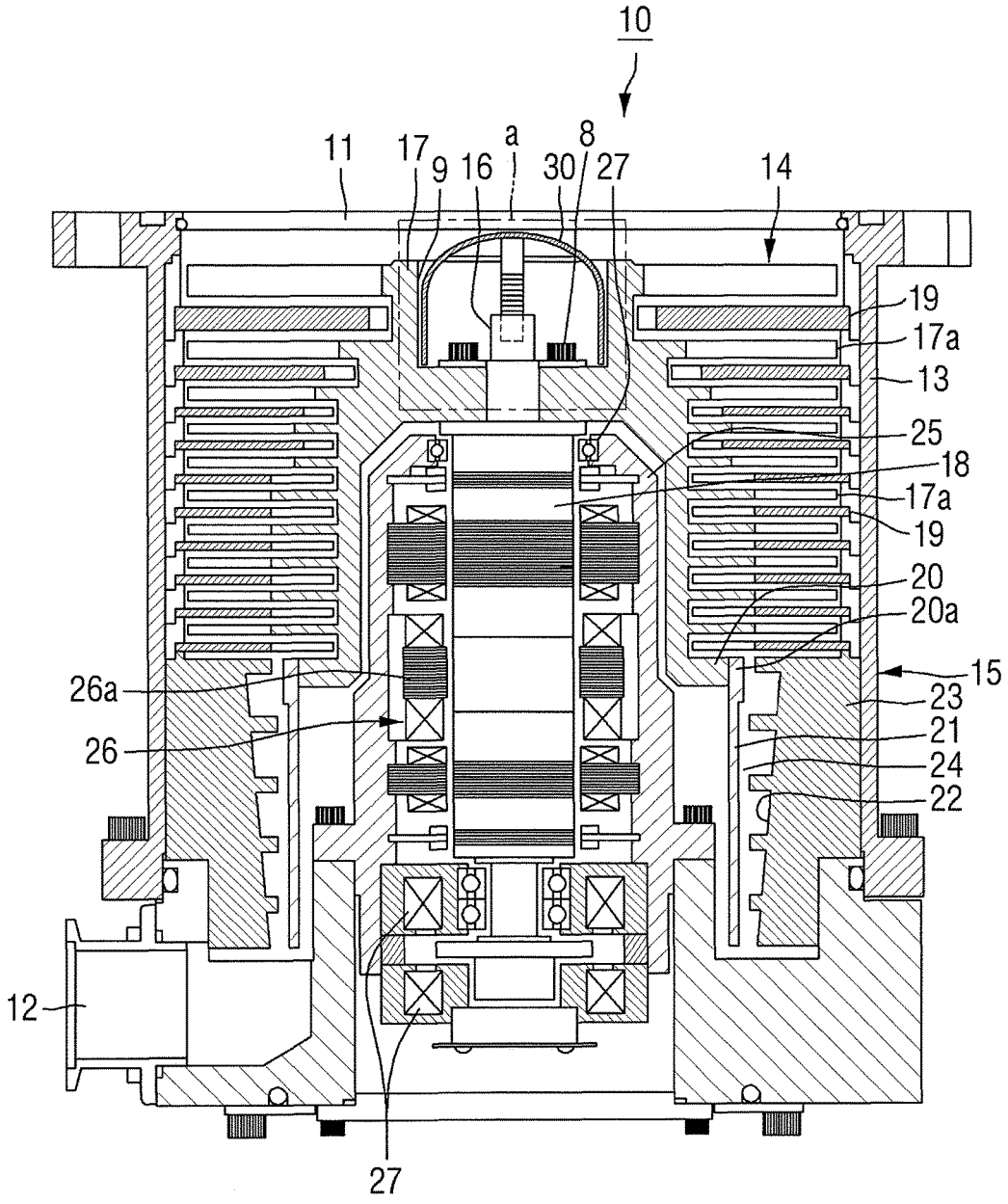
FIG. 1 illustrates a cross-sectional view of a vacuum pump according to some example embodiments.

FIG. 1 is a cross-sectional view of a vacuum pump according to some exemplary embodiments. FIG. 2 is an enlarged cross-sectional view of an area "a" of FIG. 1.

Figure 2:
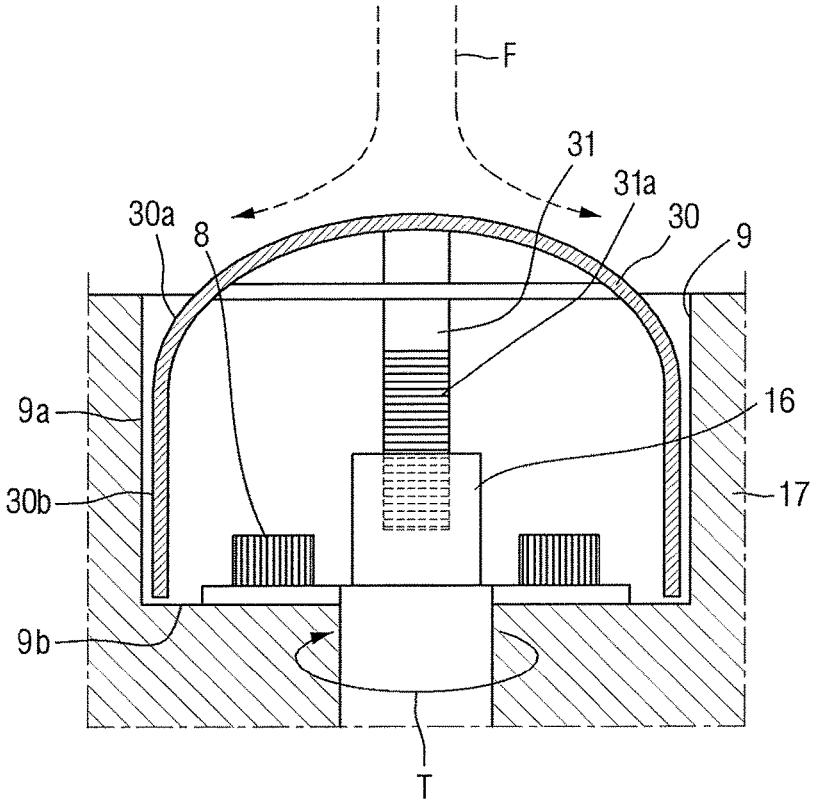
FIG. 2 illustrates an enlarged cross-sectional view of an area "a" of FIG. 1.

Referring to FIGS. 1 and 2, a vacuum pump 10 may include a housing 13, which has an inlet port 11 and an outlet port 12, e.g., the inlet port 11 may overlap a majority of the top of the housing 13. In the housing 13, a turbo pump unit 14, which is provided at the top of the housing 13, and a thread groove pump unit 15, which is provided at the bottom of the housing 13 and is cylindrical, may be installed. That is, the vacuum pump 10 may be a hybrid pump including the turbo pump unit 14 and the thread groove pump unit 15.

For example, the housing 13 may be cylindrical, and may include a rotor shaft 18, which is rotatably supported within the housing 13, and a high-frequency motor 26, which drives the rotor shaft 18. The housing 13 may also include a plurality of rotating blades 17*a*, which are fixed to the top of the rotor shaft 18 and are installed concentrically around the axis of the rotor shaft 18 to be in parallel to one another.

An exhaust passage 24 is formed through the interior of the turbo pump unit 14 and the thread groove pump unit 15 to be in communication with the inlet port 11 and the outlet port 12. In detail, the exhaust passage 24 allows a gap between the inner circumferential surface of the turbo pump unit 14 and the outer circumferential surface of a rotor part 17, and a gap between the inner circumferential surface of a stator 23 of the thread groove pump unit 15 and the outer circumferential surface of a cylindrical rotor 21 to communicate with each other. Also, the exhaust passage 24 is formed so as to allow the upper end side of the gap in the turbo pump unit 14 to communicate with the inlet port 11, and to allow the lower end side of the gap in the thread groove pump unit 15 to communicate with the outlet port 12.

The turbo pump unit 14 may be obtained by combining the rotating blades 17*a*, which are installed to project from the outer circumferential surface of the rotor part 17, with a plurality of fixed blades 19, which are installed to project from the inner circumferential surface of the housing 13. The rotating blades 17*a* may be made of an aluminum alloy and may be fixedly installed at a rotating shaft 16.

The rotating shaft 16 may be disposed in a recess part 9, which is provided in the rotor part 17. The rotating shaft 16 may have a shape extending in a direction perpendicular to a plane corresponding to the inlet port 11. The rotating shaft 16 may be disposed in the recess part 9 and may have a shape extending toward the inlet port 11.

A capping part 30 may be disposed in the recess part 9 and may cover the rotating shaft 16. More specifically, as illustrated in FIG. 2, the capping part 30 may include an insertion portion 31 and may be inserted into the rotating shaft 16. Accordingly, gas flows introduced through the inlet port 11 may be prevented from rising back up through the recess part 9 or along the rotating shaft 16, and this will be described later in detail.

The thread groove pump unit 15 may include the cylindrical rotor 21, which is press-fitted onto a joint part 20*a*, i.e., onto the outer circumference of an annular-brim part 20 that is installed to project from the outer circumferential surface of a lower end portion of the rotor part 17 in the turbo pump unit 14 via, e.g., adhesive. The thread groove pump unit 15 may further include the stator 23, which faces the outer circumference of the cylindrical rotor 21 with a small gap therebetween and forms part of the exhaust passage 24 together with the small gap.

A thread groove 22 is formed in the stator 23 to become shallower in a downward direction. The stator 23 is fixed to the inner side of the housing 13. A lower end of the thread groove 22 is installed to communicate with the outlet port 12 at the furthest downstream side of the exhaust passage 24, and the rotor part 17 of the turbo pump unit 14 with the joint part 20*a* of the cylindrical rotor 21 of the thread groove pump unit 15 are installed upstream of the exhaust passage 24.

A rotor 26*a* of a high-frequency motor 26, e.g., an induction motor, may be installed in a motor housing 25, which is fixed to an intermediate portion of the rotating shaft 16. The rotating shaft 16 is supported on a magnetic bearing, and is provided with protective bearings 27, which are installed at the top and the bottom of the rotating shaft 16.

The cylindrical rotor 21 is formed in a cylindrical shape using a fiber-reinforced plastic (FRP) material. The cylindrical rotor 21 is provided in the form of a composite layer obtained by combining a hoop layer, in which fibers are aligned in a circumferential direction, and a helical layer, in which fibers are aligned at an angle of 45 degrees or greater with respect to the circumferential direction, so as to share forces in both the circumferential direction and an axial direction.

For example, bolts 8 may be disposed on both sides of the rotating shaft 16. The rotor part 17 may be connected to the rotor shaft 18 through the bolts 8. In another example, the bolts 8 may not be provided.

The rotor part 17 of the turbo pump unit 14 and an upper portion of the thread groove pump unit 15, where the cylindrical rotor 21 corresponds with the joint part 20*a*, i.e., an outermost part of an upper portion of the cylindrical rotor 21, may be smoothed by spraying a resin material to fill any recesses thereon.

The operation of the vacuum pump 10 of FIG. 1 will hereinafter be described. Gas that flows in through the inlet port 11, as a result of driving by the high-frequency motor 26, is in a molecular flow state or in an intermediate flow state close to a molecular flow state. For example, the gas flow entering the inlet port 11 may flow toward the recess part 9 surrounding a top of the rotating shaft 16, as well as toward the rotating blades 17*a* and the fixed blades 19 surrounding the recess part 9. The rotating blades 17*a* in the turbo pump unit 14, e.g., turbo molecular pump, and the fixed blades 19 that project from the housing 13 impart downward momentum to molecules of the gas, so the gas is compressed and pushed to move downwardly, i.e., toward the thread groove pump unit 15, by the rotating blades 17*a* that rotate at high speed.

The compressed and moving gas is guided, in the thread groove pump unit 15, by the cylindrical rotor 21, and by the thread groove 22 that becomes shallower along the stator 23 that is formed to have a small gap with the cylindrical rotor 21. The gas flows through the interior of the exhaust passage 24 while being compressed up to a viscous flow state, and is discharged out of the outlet port 12.

The capping part 30 is disposed in the recess part 9 of the rotor part 17, and faces the inlet port 11. Therefore, a reverse flow of the gas introduced through the inlet port 11 may be prevented by the capping part 30, as will be described in further detail with reference to FIG. 2 below.

Referring again to FIG. 2, the capping part 30, which includes a curved portion 30*a* and a side portion 30*b*, may be disposed in the recess part 9. The capping part 30 may further include the insertion portion 31, which has a screw section 31*a*.

The curved portion 30*a* may have a predetermined curvature, and the side portion 30*b* may be flat, e.g., to have a linear cross-section. As illustrated in FIG. 2, part of the curved portion 30*a* may be disposed inside the recess part 9. That is, the capping part 30 may be inserted deep in the recess part 9, so the capping part 30 may be stably disposed in the recess part 9 and may maintain a stable posture throughout the high-speed rotation of the rotor part 17. For example, as illustrated in FIG. 2, a height of the side portion 30*b* of the capping part 30 may be shorter than a depth of the recess part 9. For example, as further illustrated in FIG. 2, the side portion 30*b* of the capping part 30 may positioned adjacent, e.g., in close proximity, to inner sidewalls of the recess part 9. Accordingly, positioning of a bottom end of the side portion 30*b*, e.g., directly, on the bottom of the recess part 9 may allow the recess part 9 to accommodate, e.g., surround, the entire side portion 30*b* and part of the curved portion 30*a* of the capping part 30 therein, thereby securing the capping part 30 at a stable position.

As mentioned above, the curved portion 30*a* may have a predetermined curvature and may face the inlet port 11. That is, as illustrated in FIG. 2, the curved portion 30*a* may be convex with respect to the recess part 9, i.e., bulging out of a top pf the recess part 9 toward the inlet port 11. Thus, gas flows F may effectively move along the curved portion 30*a* toward the side portion 30*b* of the capping part 30 due to the curvature of the curved portion 30*a*, e.g., compared to a capping part that does not have any curvature.

Since the curved portion 30*a* faces the inlet port 11, the gas flows F from the inlet port 11 may press the curved portion 30*a* against the bottom of the recess part 9. Accordingly, the capping part 30 may be further stably disposed in the recess part 9.

The insertion portion 31 may be disposed in the middle of the curved portion 30*a*. The insertion portion 31 may have a, e.g., rod, shape extending from the curved portion 30*a* toward the rotating shaft 16. The insertion portion 31, which extends to the rotating shaft 16, may be inserted into the rotating shaft 16. For example, the screw section 31*a* of the insertion portion 31 may be a male screw, and a female screw, into which the screw section 31*a* is to be inserted, may be disposed inside the rotating shaft 16. However, the example embodiments are not limited thereto, e.g., the rotating shaft 16 may have a male screw with a smaller diameter than the insertion portion 31 and may be inserted into the insertion portion 31 having a female screw.

As mentioned above, the insertion portion 31 and the rotating shaft 16 may be screw-coupled to each other. As viewed from the same direction, a direction in which the insertion portion 31 and the rotating shaft 16 are screw-coupled to each other may differ from a rotation direction T of the rotating shaft 16. Accordingly, during the high-speed rotation of the rotating shaft 16, the insertion portion 31 and the rotating shaft 16 may be prevented from being unscrewed from each other and may thus remain firmly coupled to each other.

The insertion portion 31 is illustrated as being inserted halfway into the rotating shaft 16, but example embodiments are not limited thereto. The depth of insertion of the insertion portion 31 into the rotating shaft 16 may be freely set in consideration of the rotation speed of the rotating shaft 16 and the size and weight of the capping part 30.

The recess part 9 may include an inner sidewall 9*a* and a bottom 9*b*. The inner sidewall 9*a* of the recess part 9 and the side portion 30*b* of the capping part 30 may face each other. The inner sidewall 9*a* and the side portion 30*b* are illustrated as being spaced apart from each other, but example embodiments are not limited thereto, e.g., the inner sidewall 9*a* and the side portion 30*b* may abut each other. In a case in which the inner sidewall 9*a* and the side portion 30*b* abut each other, e.g., directly contact each other, gas flows F may be prevented from being introduced into the capping part 30. In addition, the capping part 30 may abut the bottom 9*b*. In a case in which the capping part 30 and the bottom 9*b* abut each other, gas flows F may be prevented from being introduced into the capping part 30.

Since the gas flows F are prevented from being introduced into the capping part 30, the air pressure inside the capping part 30 and the air pressure outside the capping part 30 may differ from each other. That is, the air pressure inside the capping part 30 may be relatively lower than the air pressure outside the capping part 30. Thus, the capping part 30 may be further stably disposed in the recess part 9 due to the difference in the air pressure between the inside and the outside thereof.

If the capping part 30 were not provided, the gas flows F would flow into the recess part 9 and collide with the inner sidewall 9*a* and the bottom 9*b*, thereby changing flow direction, i.e., flowing in a different direction from a direction in which the gas flows F were initially introduced into the recess part 9. When the gas flows F flow in a different direction from the direction in which they are introduced, impurities including fine particles may be introduced into a chamber to which the vacuum pump 10 is connected. In this case, the reliability of a semiconductor fabrication process performed in the chamber may decrease, and as a result, the defect rate of semiconductor devices fabricated by the semiconductor fabrication process may increase.

Also, if the capping part 30 were not provided, the rotating shaft 16 would be exposed to the outside of the vacuum pump 10 through the recess part 9. Since the rotating shaft 16 rotates at high speed, unintended gas flows may be added to the gas flows F introduced through the inlet port 11. That is, in a case in which the gas flows F rotate due to the rotation of the rotating shaft 16 and thus flow in a different direction from the direction in which they are introduced, impurities including fine particles may be introduced into the chamber to which the vacuum pump 10 is connected.

In the present exemplary embodiment, since the capping part 30 is stably disposed in the recess part 9, the gas flows F introduced through the inlet port 11 may be effectively induced to flow to the outlet port 12 without flowing backward. By preventing the gas flows F from flowing backward into the chamber to which the vacuum pump 10 is connected, impurities including fine particles may be prevented from being introduced into the chamber. Also, in the present exemplary embodiment, since the capping part 30 is stably coupled to the rotating shaft 16 through the screw section 31*a* of the insertion portion 31, and the rotation direction of the screw-coupling between the screw section 31*a* and the rotating shaft 16 differs from the rotation direction T of the rotating shaft 16, the capping part 30 may be prevented from being detached even during the high-speed rotation of the rotating shaft 16.

A vacuum pump according to some other exemplary embodiments will hereinafter be described in further detail with reference to FIG. 3.

Figure 3:
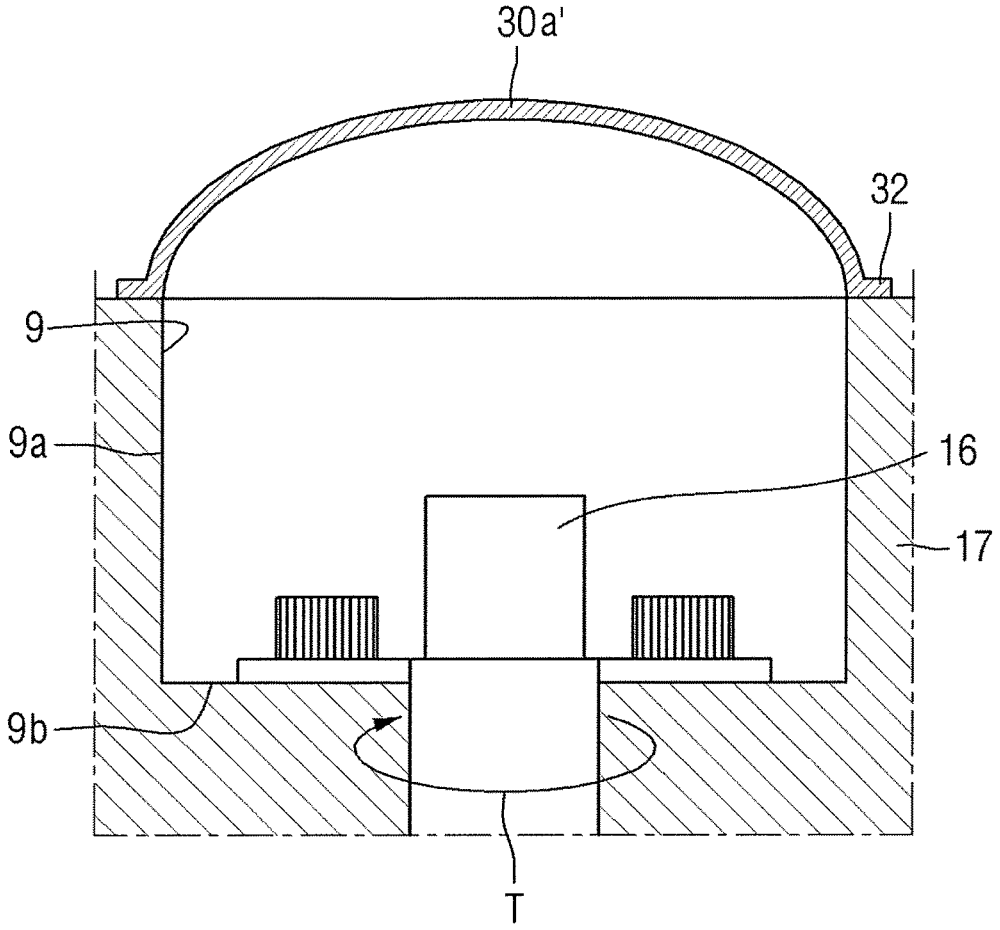
FIG. 3 illustrates an enlarged view of an area of a vacuum pump according to some other example embodiments.

FIG. 3 is an enlarged view of an area of a vacuum pump according to some other exemplary embodiments. The area illustrated in FIG. 3 may be substantially the same as the area "a" of FIG. 1.

The vacuum pump according to the present exemplary embodiment is the same as the vacuum pump according to the exemplary embodiment of FIG. 1, except for the area "a". In FIGS. 1 and 3, like reference numerals indicate like elements, and thus, detailed descriptions thereof will be omitted.

Referring to FIG. 3, a capping part may include a curved portion 30*a*' and may further include a coupling portion 32 at the end thereof. The capping part may completely cover the recess part 9, in which case, due to the presence of the capping part, the recess part 9 may be prevented from being in contact with the outside of the capping part. Accordingly, no gas flows may be introduced into the recess part 9.

The capping part may include the coupling portion 32 at the end of the curved portion 30*a*', and may thus be mechanically coupled to the top surface of a rotor part 17. The capping part, unlike its counterpart of FIG. 1, does not include a side portion 30*b*, but only includes the curved portion 30*a*' above the rotor part 17, with the coupling portion 32 attached to the top surface of the rotor part 17. Due to such a relatively simple structure of the capping part, gas flows may be prevented from being introduced into the recess part 9.

A vacuum pump according to some other exemplary embodiments will hereinafter be described in further detail with reference to FIG. 4.

Figure 4:
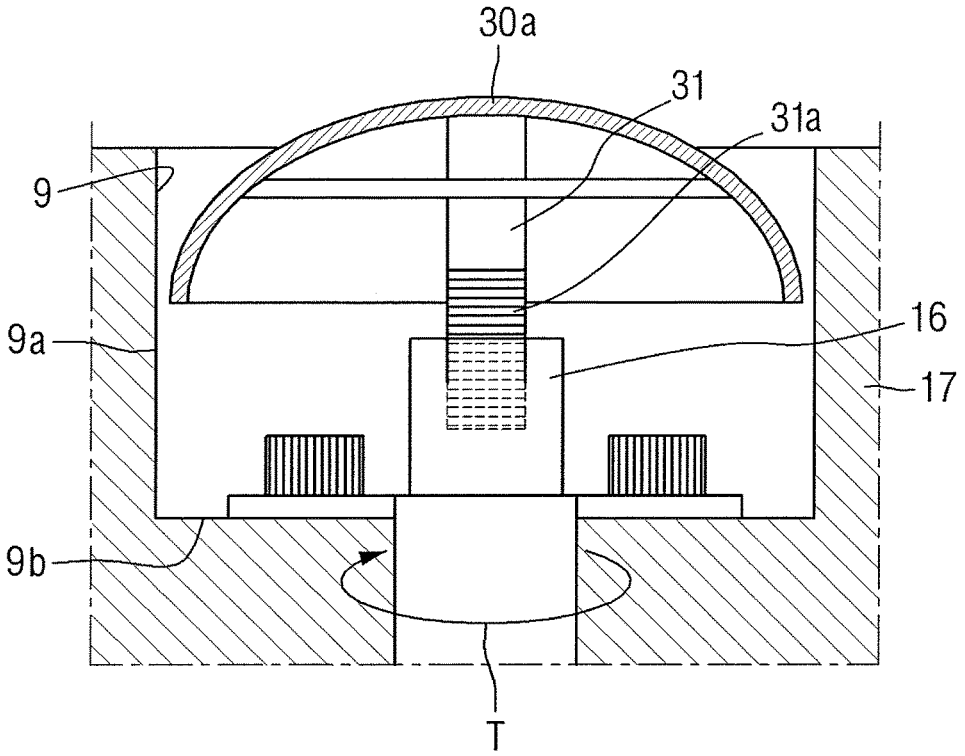
FIG. 4 illustrates an enlarged view of an area of a vacuum pump according to some other example embodiments.

FIG. 4 is an enlarged view of an area of a vacuum pump according to some other exemplary embodiments. The area illustrated in FIG. 4 may be substantially the same as the area "a" of FIG. 1.

The vacuum pump according to the present exemplary embodiment is the same as the vacuum pump according to the exemplary embodiment of FIG. 1, except area "a". In FIGS. 1 and 4, like reference numerals indicate like elements, and thus, detailed descriptions thereof will be omitted.

Referring to FIG. 4, a capping part may be disposed in the recess part 9 and may be formed in the shape of an umbrella. That is, the capping part, unlike its counterpart of FIG. 1, may include only the curved portion 30*a* without the side portion 30*b*.

An end portion of the capping part 30 is illustrated as being spaced apart from an inner sidewall 9*a* of the recess part 9, but the example embodiments are not limited thereto. That is, alternatively, the end portion of the curved portion 30*a* of the capping part and the inner sidewall 9*a* of the recess part 9 may abut each other. In a case in which the end portion of the capping part and the inner sidewall 9*a* of the recess part 9 abut each other, gas flows may be further effectively prevented from being introduced into the recess part 9.

As discussed previously, the capping part in FIG. 4, unlike its counterpart of FIG. 1, does not include a side portion 30*b*, but only includes the curved portion 30*a*. Due to such a relatively simple structure of the capping part, gas flows may be prevented from being introduced into the recess part 9. Also, the capping part in FIG. 4, unlike its counterpart of FIG. 3, includes the insertion portion 31 having the screw section 31*a*. Thus, the capping part may be stably disposed within the recess part 9 even during the high-speed rotation of the rotating shaft 16.

A vacuum pump according to some other exemplary embodiments will hereinafter be described in further detail with reference to FIG. 5.

Figure 5:
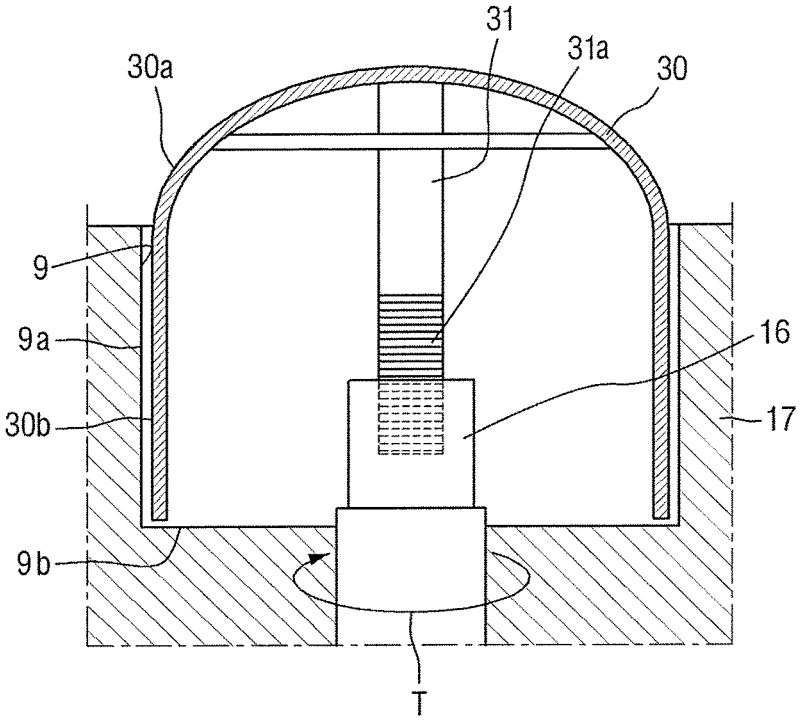
FIG. 5 illustrates an enlarged view of an area of a vacuum pump according to some other example embodiments.

FIG. 5 is an enlarged view of an area of a vacuum pump according to some other exemplary embodiments. The area illustrated in FIG. 5 may be substantially the same as the area "a" of FIG. 1.

The vacuum pump according to the present exemplary embodiment is the same as the vacuum pump according to the exemplary embodiment of FIG. 1, except for the area "a". In FIGS. 1 and 5, like reference numerals indicate like elements, and thus, detailed descriptions thereof will be omitted.

Referring to FIG. 5, the entire curved portion 30*a* of a capping part may be disposed outside the recess part 9. That is, only the side portion 30*b* of the capping part may be disposed within the recess part 9.

In the present exemplary embodiment, the entire curved portion 30*a* is disposed outside the recess part 9, and thus, the profile of the curved portion 30*a* may be relatively smoothly connected to the profile of the top surface of a rotor part 17, compared to the previous exemplary embodiments. That is, in the present exemplary embodiment, since the entire curved portion 30*a* is disposed outside the recess part 9, gas flows introduced through the inlet port 11 may be effectively induced to the outlet port 12 without having direct contact between the recess part 9 and the gas flows F, thereby further minimizing a potential for the gas flows to flow backward.

A vacuum pump according to some other exemplary embodiments will hereinafter be described with reference to FIGS. 6 through 8.

Figure 6:
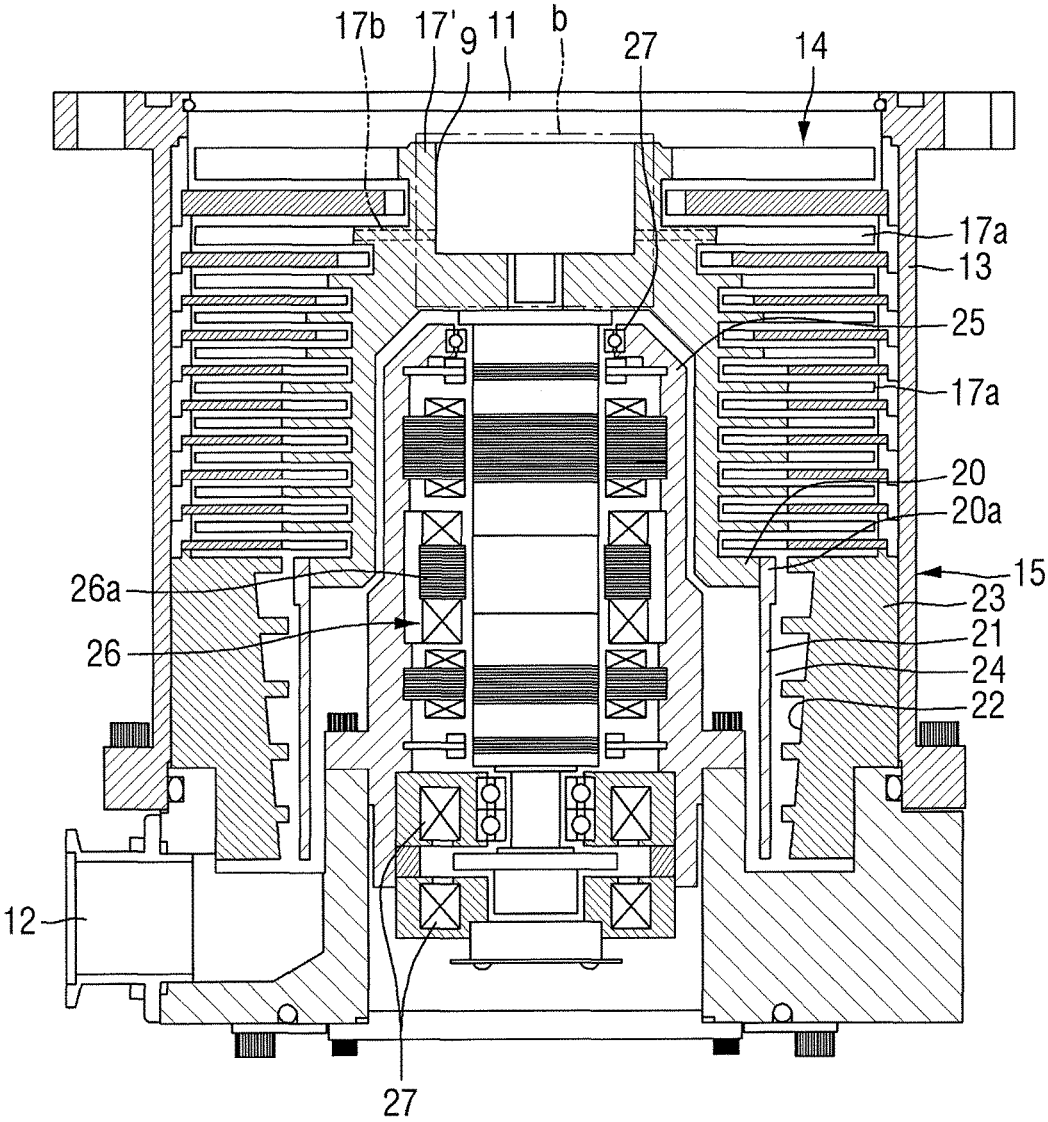
FIG. 6 illustrates a cross-sectional view of a vacuum pump according to some other example embodiments.

FIG. 6 is a cross-sectional view of a vacuum pump according to some other exemplary embodiments. FIG. 7 is a perspective view illustrating the arrangement of exhaust holes in a rotor part included in the vacuum pump of FIG. 6. FIG. 8 is a cross-sectional view illustrating an area b of FIG. 6.

Figure 7:
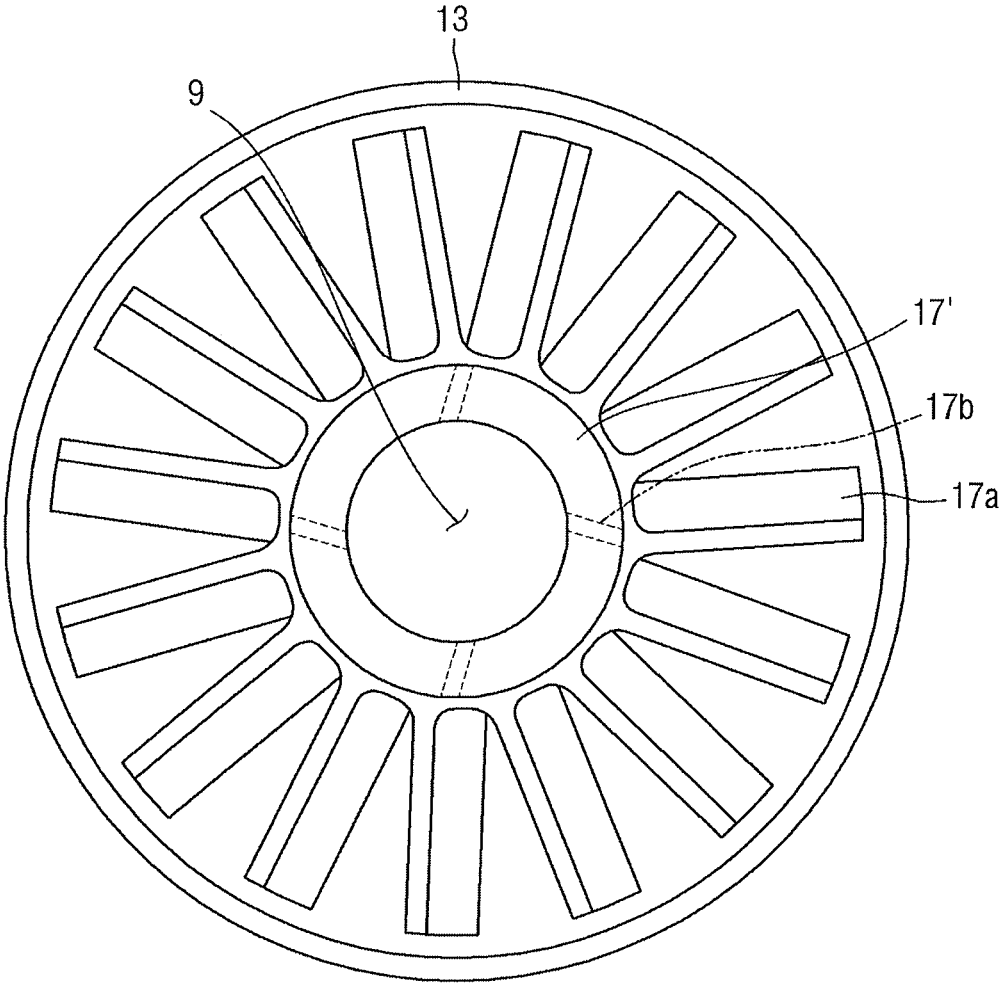
FIG. 7 illustrates a perspective view of the arrangement of exhaust holes in a rotor part included in the vacuum pump of FIG. 6.

It is noted that FIG. 7 mainly illustrates a rotor part and rotating blades included in the rotor part for convenience, but the elements of the vacuum pump according to the present exemplary embodiment are not limited to those illustrated in FIG. 7.

The present exemplary embodiment is substantially the same as the exemplary embodiment of FIG. 1, except that exhaust holes are provided in the recess part 9 except a rotating shaft. In FIGS. 1 and 7, like reference numerals indicate like elements, and thus, detailed descriptions thereof will be omitted.

Figure 8:
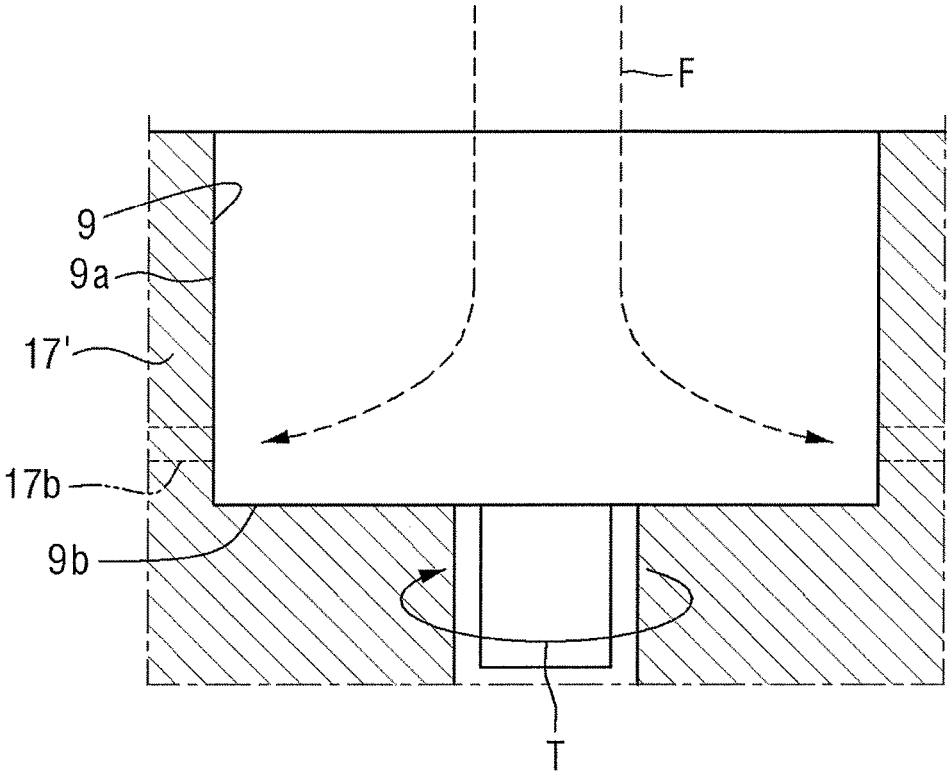
FIG. 8 illustrates a cross-sectional view of an area "b" of FIG. 6.

Referring to FIGS. 6 through 8, a rotor part 17' may include exhaust holes 17*b*. The rotor part 17' may also include a plurality of rotating blades 17*a*.

The exhaust holes 17*b* may extend between the rotating blades 17*a* through the recess part 9. The exhaust holes 17*b* may extend between, e.g., among, the rotating blades 17*a* to penetrate the rotor part 17'. Accordingly, gas flows F introduced into the recess part 9 may be discharged through the exhaust holes 17*b*.

Each of the exhaust holes 17*b* may extend with a slope with respect to a plane corresponding to the inner sidewall 9*a* of the recess part 9 where they begin to extend. That is, as illustrated in FIG. 7, each of the exhaust holes 17*b* may extend in a direction not perpendicular to the inner sidewall 9*a* of the recess part 9, e.g., each of the exhaust holes 17*b* may extend at an oblique angle with respect to a tangent line at an intersection point of the exhaust hole 17*b* with the inner sidewall 9*a* of the recess part 9, but the example embodiments are not limited thereto.

In the present exemplary embodiment, no capping part 30 is provided in the recess part 9, and to prevent the gas flows F introduced into the recess part 9 from flowing backward, the exhaust holes 17*b* are provided. The exhaust holes 17*b* are not limited to the size illustrated in FIGS. 6 through 8, and the size of the exhaust holes 17*b* may vary depending on the amount of the gas flows F introduced into the recess part 9, the size of the rotor part 17', the number of rotating blades 17*a*, and the distance between the rotating blades 17*a*.

A vacuum pump according to some other exemplary embodiments will hereinafter be described with reference to FIGS. 9 and 10.

Figure 9:
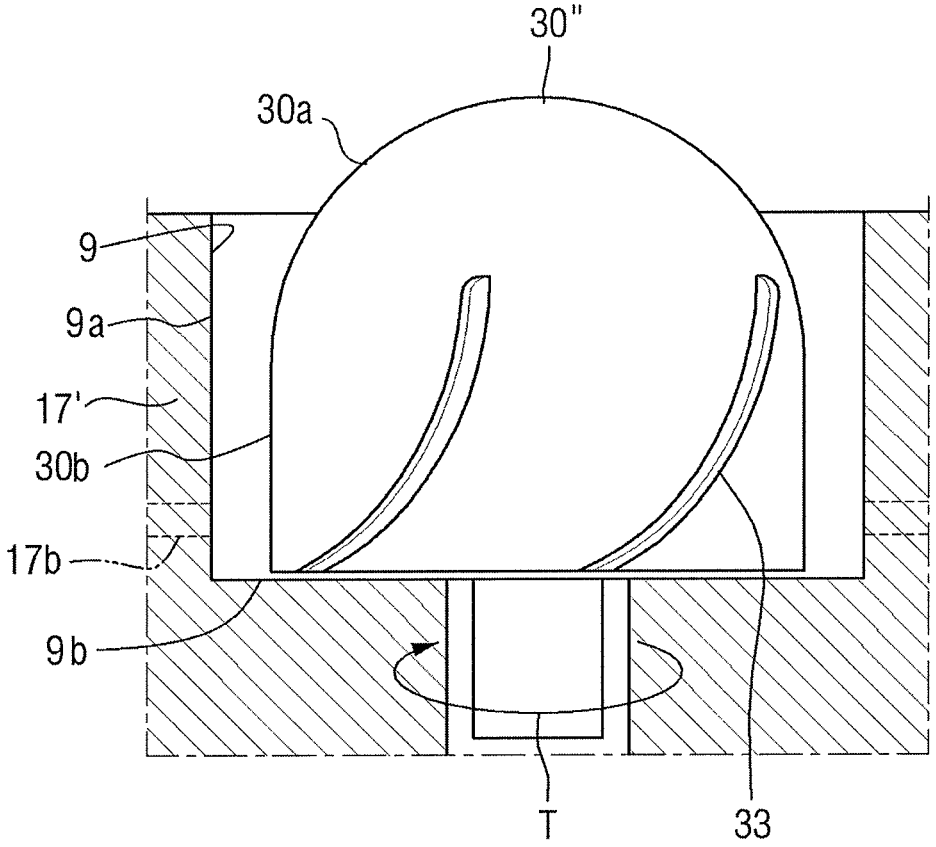
FIG. 9 illustrates an enlarged view of an area of a vacuum pump according to some other example embodiments.

FIG. 9 is an enlarged view of an area of a vacuum pump according to some other exemplary embodiments. FIG. 10 is a perspective view illustrating the shape of a capping part included in the vacuum pump of FIG. 9.

The area illustrated in FIG. 9 may be substantially the same as the area "a" of FIG. 1. The vacuum pump according to the present exemplary embodiment is the same as the vacuum pump according to the exemplary embodiment of FIGS. 6-8, except for the area "a". In FIGS. 1, 9, and 10, like reference numerals indicate like elements, and thus, detailed descriptions thereof will be omitted.

In the present exemplary embodiment, like in the exemplary embodiment of FIGS. 6 through 8, the rotor part 17' may include exhaust holes 17*b*. The exhaust holes 17*b* have already been described above with reference to FIGS. 6 through 8, and thus, a detailed description thereof will be omitted.

To properly illustrate projecting blades 33 included in a capping part 30", a perspective view of the capping part 30" that shows projecting blades 33, instead of a cross-sectional view of the capping part, is provided. In the present exemplary embodiment, like in the exemplary embodiment of FIG. 2, the capping part 30" may include the insertion portion 31 having the screw section 31*a* in the middle of the curved portion 30*a* and may thus be screw-coupled to the rotating shaft 16, but the example embodiments are not limited thereto.

Figure 10:
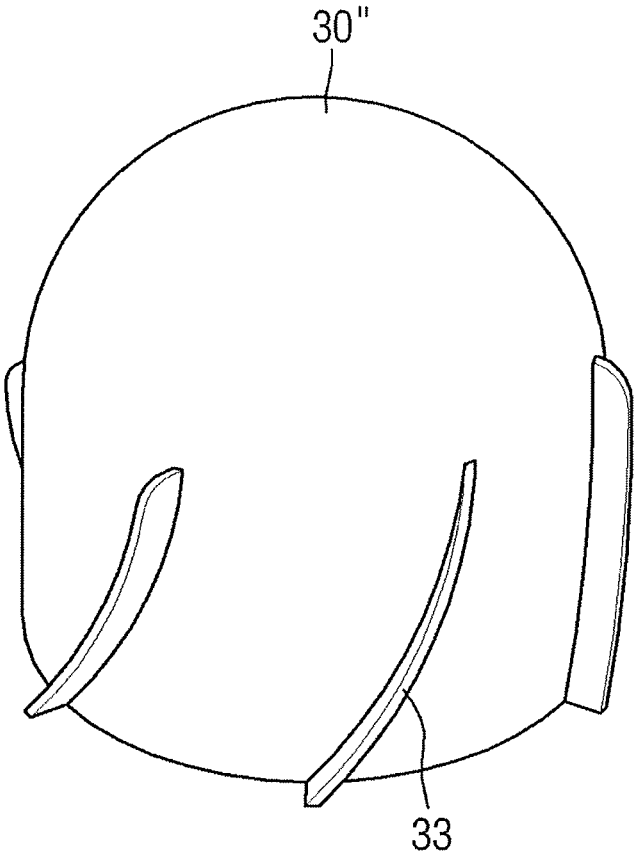
FIG. 10 illustrates a perspective view of a shape of a capping part included in the vacuum pump of FIG. 9.

Referring to FIGS. 9 and 10, the capping part 30" includes the projecting blades 33. More specifically, a plurality of projecting blades 33 may be provided to be spaced apart from each other by a predetermined gap and to project from the surface of the capping part 30". For example, as illustrated in FIG. 10, the projecting blades 33 may extend along an external surface of the side portion 30*b* of the capping part 30", e.g., to face the inner sidewall 9*a* of the recess part 9.

In the present exemplary embodiment, the side portion 30*b* of the capping part 30" may be spaced apart from the inner sidewall 9*a* of the recess part 9. That is, gas flows introduced through the inlet port 11 may flow along the curved portion 30*a* of the capping part 30" and may thus be introduced into the exhaust holes 17*b* by the projecting blades 33, e.g., the projecting blades 33 facilitate movement of the gas flows from the inlet port 11 toward the exhaust holes 17*b*.

In the present exemplary embodiment, the capping part 30", which is coupled to the rotating shaft 16, includes the projecting blades 33 and may thus effectively guide gas flows introduced through the inlet port 11 to an outlet port 12. That is, the vacuum pump according to the present exemplary embodiment includes the exhaust holes 17*b* and the capping part 30" having the projecting blades 33, and may thus quickly change the direction of gas flows and guide them to the outlet port 12, e.g., thereby preventing gas flow backward.

A vacuum pump according to some other exemplary embodiments will hereinafter be described with reference to FIG. 11.

Figure 11:
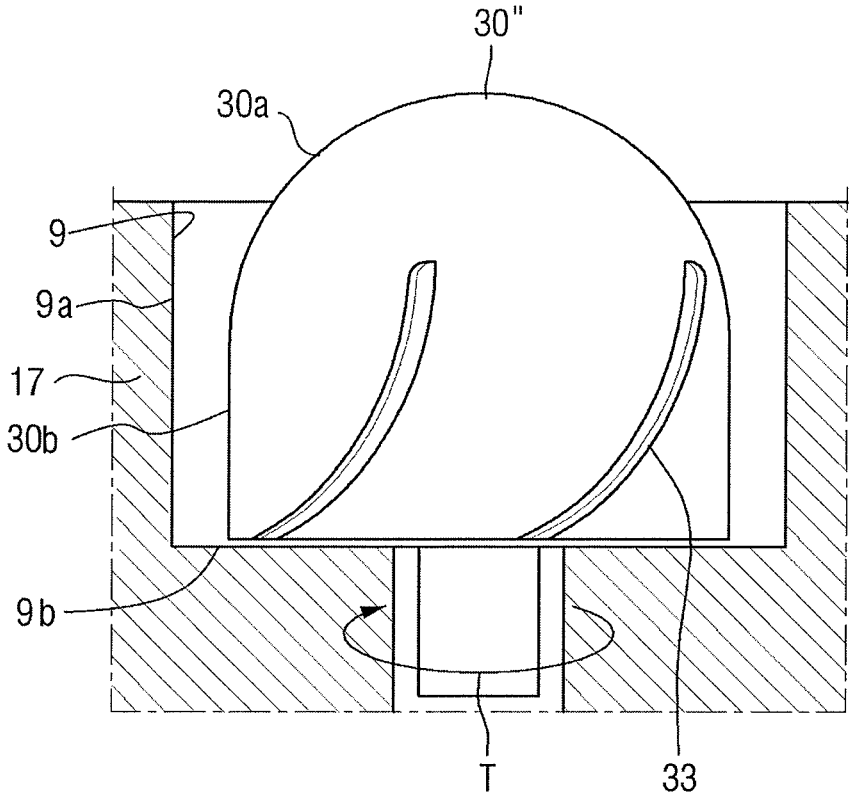
FIG. 11 illustrates an enlarged view of an area of a vacuum pump according to some other example embodiments.

FIG. 11 is an enlarged view of an area of a vacuum pump according to some other exemplary embodiments. The area illustrated in FIG. 11 may be substantially the same as the area "a" illustrated in FIG. 9. The vacuum pump according to the present exemplary embodiment is the same as the vacuum pump according to the exemplary embodiment of FIG. 9, except that the rotor part 17 does not include exhaust holes 17*b*. In FIGS. 9 and 11, like reference numerals indicate like elements, and thus, detailed descriptions thereof will be omitted.

Referring to FIG. 11, in the present exemplary embodiment, gas flows introduced through the inlet port 11 may be effectively guided to the outlet port 12 by the capping part 30" having the projecting blades 33. That is, the vacuum pump according to the present exemplary embodiment includes the capping part 30" having the projecting blades 33 and may thus quickly change the direction of gas flows introduced through the inlet port 11 with the use of the projecting blades 33 during the high-speed rotation of a rotating shaft 16.

Also, the vacuum pump according to the present exemplary embodiment, unlike the vacuum pump according to the exemplary embodiment of FIG. 9, does not include exhaust holes 17*b*. Thus, the structure of the vacuum pump according to the present exemplary embodiment is simplified.

By way of summation and review, a vacuum pump may include a housing, which forms an external body having an inlet port and an outlet port. A structure for performing an exhaust function is received in the housing. The structure for performing an exhaust function may include a rotor part, which is coupled to the housing to be freely rotatable, and a stator part, which is fixed to the housing.

Also, a motor for rotating a rotating shaft at high speed may be installed in the housing. In response to the rotating shaft being rotated at high speed by the motor, gas is introduced through the inlet port and discharged through the outlet port according to the interaction between rotor blades (or rotor disks) and stator blades (or stator disks). The rotating shaft of a vacuum pump may be disposed in a recess region of the rotor part, and an end portion of the rotating shaft may be exposed through the outlet port of the housing. However, the exposed end portion of the rotating shaft or the recess region of the rotor part may form a reverse gas flow during operation of the vacuum pump, thereby reducing operational reliability.

In contrast, example embodiments provide a vacuum pump with an improved reliability. That is, example embodiments provide a vacuum pump with a capping part overlapping the rotating shaft and covering the recess part, thereby preventing a reverse gas flow from occurring at an inlet port of a housing. As a reverse gas flow is prevented, impurity particles are prevented from being introduced into a chamber via a reverse gas flow at an inlet port of the housing.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A vacuum pump, comprising:

a housing including an inlet port;

a rotor part in the housing, the rotor part including:

a recess part through an upper portion of the rotor part, the recess part facing the inlet port, and a plurality of rotating blades external to the recess part;

a rotating shaft extending into the recess part; and a capping part overlapping the rotating shaft and covering the recess part, the inlet port of the housing overlapping an entire width of the capping part, wherein the rotor part further includes exhaust holes external to the recess part and extending from the recess part among the plurality of rotating blades, longitudinal directions of the exhaust holes extending in a plane parallel to a bottom of the recess part.

2. The vacuum pump as claimed in claim 1, wherein the capping part includes a side portion and a curved portion, the side portion being inserted into the recess part and facing an inner sidewall of the recess part, and the curved portion protruding outside the recess part and facing the inlet port.

3. The vacuum pump as claimed in claim 2, wherein the side portion of the capping part and the inner sidewall of the recess part contact each other.

4. The vacuum pump as claimed in claim 2, wherein only part of the curved portion is inside the recess part.

5. The vacuum pump as claimed in claim 1, wherein the capping part includes a coupling portion coupled to a topmost surface of the rotor part, the capping part completely sealing the recess part.

6. The vacuum pump as claimed in claim 1, wherein the capping part includes a side portion and a curved portion, the side portion being inside the recess part to face an inner sidewall and spaced apart from the exhaust holes, and the curved portion facing the inlet port.

7. The vacuum pump as claimed in claim 6, wherein the capping part further includes projecting blades on a surface thereof.

8. The vacuum pump as claimed in claim 1, wherein the capping part includes an insertion portion in a center thereof, the insertion portion being coupled to the rotating shaft.

9. The vacuum pump as claimed in claim 8, wherein:

the insertion portion is screw-coupled to the rotating shaft; and a rotation direction of the screw-coupling between the insertion portion and the rotating shaft differs from a rotation direction of the rotating shaft.

10. A vacuum pump, comprising:

a housing including an inlet port; and a rotor part in the housing, the rotor part including:

a recess part facing the inlet port, a plurality of rotating blades, and a plurality of exhaust holes extending radially from the recess part toward a sidewall of the housing, the plurality of exhaust holes being among the plurality of rotating blades.

11. The vacuum pump as claimed in claim 10, further comprising a capping part in the recess part and including a side portion, the side portion being spaced apart from the exhaust holes.

12. The vacuum pump as claimed in claim 11, wherein the capping part further includes projecting blades on a surface thereof.

13. The vacuum pump as claimed in claim 11, wherein the capping part further includes an insertion portion in a center thereof, the insertion portion being coupled to a rotating shaft.

14. The vacuum pump as claimed in claim 10, wherein:

the recess part includes an empty volumetric space, the plurality of rotating blades are external to the recess part, and the plurality of exhaust holes are external to the recess part and in fluid communication with the empty volumetric space of the recess part.

15. A vacuum pump, comprising:

a housing including an inlet port;

a rotor part in the housing, the rotor part including:

a recess part through an upper portion of the rotor part, the recess part facing the inlet port, and a plurality of rotating blades, some of the plurality of rotating blades extending from a sidewall of the recess part toward a sidewall of the housing;

a rotating shaft extending through a bottom of the recess part toward the inlet port; and a capping part at least partially inserted into the recess part, the capping part overlapping the rotating shaft and a top of the recess part, wherein the rotor part further includes exhaust holes external to the recess part and extending from the recess part among the plurality of rotating blades, longitudinal directions of the exhaust holes extending in a plane parallel to a bottom of the recess part.

16. The vacuum pump as claimed in claim 15, wherein the capping part includes a curved portion overlapping a center of the recess part in a top view, the curved portion bulging out of the recess part toward the inlet port.

17. The vacuum pump as claimed in claim 16, wherein a lower portion of the curved portion overlaps an inner sidewall of the recess part, an upper portion of the curved portion is outside the recess part, and a width of a widest portion of the curved portion overlaps at least a majority of a width of the recess part.

18. The vacuum pump as claimed in claim 17, wherein the capping part further includes a side portion extending from the lower portion of the curved portion toward the bottom of the recess part, the side portion being adjacent to and parallel to an inner sidewall of the recess part.

19. The vacuum pump as claimed in claim 15, wherein the capping part has a dome shape covering a bottom and sidewalls of the recess part, the plurality of rotating blades being external to the recess part and to the dome shaped capping part.

* * * * *